US008146965B2

(12) United States Patent
Akizuki et al.

(10) Patent No.: US 8,146,965 B2
(45) Date of Patent: Apr. 3, 2012

(54) VEHICLE DOOR LOCK DEVICE

(75) Inventors: Ryujiro Akizuki, Kariya (JP); Takashi Nishio, Kariya (JP); Yusuke Yamada, Chiryu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 12/921,548

(22) PCT Filed: Mar. 12, 2009

(86) PCT No.: PCT/JP2009/054768
§ 371 (c)(1),
(2), (4) Date: Sep. 8, 2010

(87) PCT Pub. No.: WO2009/128309
PCT Pub. Date: Oct. 22, 2009

(65) Prior Publication Data

US 2010/0327609 A1 Dec. 30, 2010

(30) Foreign Application Priority Data

Apr. 18, 2008 (JP) ..... 2008-109062

(51) Int. Cl.
*E05C 3/06* (2006.01)
*E05C 3/16* (2006.01)

(52) U.S. Cl. ..... 292/201; 292/216; 292/DIG. 23

(58) Field of Classification Search ..... 292/216, 292/201, DIG. 23, DIG. 65, 1
See application file for complete search history.

(56) References Cited

U.S. PATENT DOCUMENTS 5,005,882 A * 4/1991 Fukumoto et al. ..... 292/216
5,035,453 A * 7/1991 Fukumoto et al. ..... 292/336.3
5,538,298 A * 7/1996 Ikeda ..... 292/201
5,762,383 A * 6/1998 Gomi ..... 292/216
5,876,074 A * 3/1999 Dowling ..... 292/201
(Continued)

FOREIGN PATENT DOCUMENTS

DE 102 58 645 A1 7/2004
(Continued)

OTHER PUBLICATIONS

International Search Report (PCT/ISA/210) issued on May 26, 2009, by Japanese Patent Office as the International Searching Authority for International Application No. PCT/JP2009/054768.
(Continued)

*Primary Examiner* — Carlos Lugo
*Assistant Examiner* — Alyson M Merlino
(74) *Attorney, Agent, or Firm* — Buchanan Ingersoll & Rooney PC

(57) ABSTRACT

A vehicle door lock device includes an active lever freely switchable between an unlock position and a lock position, a switching actuator, and a switching lever receiving drive force of the switching actuator to move a bushing. The active lever includes a first engagement piece and a second engagement piece. When the active lever is located at the unlock position, the second engagement piece engages with the first engagement piece located at a set position of the bushing to limit movement of the switching lever so that movement of the bushing is restricted within a range between an unset position and the set position. When the active lever is located at the lock position, the first engagement piece is arranged at a position avoiding engagement with the second engagement piece to allow the switching lever to move the bushing between the unset position and a double lock position.

20 Claims, 5 Drawing Sheets

U.S. PATENT DOCUMENTS

| | | | | |
|---|---|---|---|---|
| 5,893,593 | A * | 4/1999 | Dowling | 292/336.3 |
| 6,079,757 | A * | 6/2000 | Aubry | 292/201 |
| 6,116,664 | A * | 9/2000 | Wegner | 292/216 |
| 6,637,783 | B2 * | 10/2003 | Takamura | 292/201 |
| 2002/0171250 | A1 | 11/2002 | Kobayashi et al. | |
| 2006/0186675 | A1 * | 8/2006 | Suzumura et al. | 292/216 |
| 2008/0023971 | A1 * | 1/2008 | Akizuki et al. | 292/201 |
| 2008/0048458 | A1 * | 2/2008 | Suzumura et al. | 292/216 |
| 2011/0162419 | A1 * | 7/2011 | Akizuki et al. | 70/141 |

FOREIGN PATENT DOCUMENTS

| | | | |
|---|---|---|---|
| DE | 10 2005 052 190 | A1 | 5/2007 |
| GB | 2 349 171 | A | 10/2000 |
| JP | 7-026502 | B2 | 3/1995 |
| JP | 2001-090411 | A | 4/2001 |
| JP | 2001-271531 | A | 10/2001 |
| JP | 2005-139793 | A | 6/2005 |
| WO | WO 2010/035638 | A1 | 4/2010 |

OTHER PUBLICATIONS

International Preliminary Report on Patentability (Form PCT/IB/373) dated Nov. 30, 2010, issued by the World Intellectual Property Organization in corresponding International patent application No. PCT/JP2009/054768.

Supplementary European Search Report dated Nov. 15, 2011 issued in the corresponding European Patent Application No. 09732025.3-1267/2281987.

* cited by examiner

VEHICLE DOOR LOCK DEVICE

FIELD OF THE INVENTION

The present invention relates to a vehicle door lock device.

BACKGROUND OF THE INVENTION

Patent document 1 describes an example of a vehicle door lock device known in the prior art. The door lock device includes an actuator that pivots an output lever from a neutral position in a lock direction and an unlock direction and pivots the output lever back to the neutral position with a motor, which is capable of producing forward and reverse rotation, by means of a reduction gear mechanism. When the output lever moves in the lock direction and the unlock direction, a lock-unlock lever moves to a lock position for locking a door and an unlock position for unlocking the door. The door lock device further includes a lock-unlock operation switch, a childproof operation switch, an outside handle operation detection switch, a lock actuation detection switch, an unlock actuation detection switch, a neutral detection switch, and a control unit. The outside handle operation detection switch detects the operation of an outside handle arranged outside the vehicle. The lock actuation detection switch detects that the lock-unlock lever has reached the lock position. The unlock actuation detection switch detects that the lock-unlock lever has reached the unlock position. The neutral detection switch detects that the output lever has reached the neutral position. The control unit is connected to the motor and the switches. When the lock-unlock operation switch, which is arranged in the passenger compartment, undergoes a lock operation or an unlock operation, the control unit activates the motor to pivot the output lever in the lock direction or the unlock direction. When the lock activation detection switch or the unlock activation detection switch is activated, the control unit produces reverse rotation with the motor until the neutral detection switch is activated and returns the output lever to the neutral position. When the childproof operation switch, which is arranged in the passenger compartment, undergoes a lock operation, the control unit activates the motor to pivot the output lever in the lock direction. When the lock activation detection switch is activated, the control unit deactivates the motor to stop the output lever at a position that prevents the lock-unlock lever from moving to the unlock position. In this state, when the outside handle operation detection switch is activated, the control unit activates the motor to move the lock-unlock lever to the unlock position. This structure allows for a single motor to perform door lock and unlock operations and a childproof operation, which disables unlocking from inside the vehicle and enables unlocking from outside the vehicle.

In patent document 1, the state of each lever is detected in detail by the corresponding switch, and the motor is controlled to stop each lever. This allows for the motor to take two states (operations). Thus, the necessary number of switches increases, and the electrical structure becomes complicated. Further, when the lever state (position) is electrically detected with each switch, there is a tendency for variations to occur depending on the situation. The may produce operation failures in each state.

Patent Document 1

Japanese Examined Patent Publication 7-26502 (FIGS. 1 and 5)

SUMMARY OF THE INVENTION

It is an object of the present invention to provide a vehicle door lock device that simplifies the electrical structure and improves the reliability of the device in its entirety.

To achieve the above object, one aspect of the present invention is a door lock device for a vehicle including a latch mechanism, an inside lever, an inside open lever, a locking lever, a movable body, an electrical drive unit, a switching lever, a first engagement piece, and a second engagement piece. The latch mechanism holds a vehicle door in a closed state with respect to a vehicle body. The inside lever is operable from a passenger compartment of the vehicle. The inside open lever is linked to the latch mechanism and the inside lever and capable of releasing the vehicle door from the closed state held by the latch mechanism. The locking lever is freely switchable to an unlock position, which enables transmission of movement of the inside open lever and operation force from outside the vehicle to the latch mechanism in order to operate the latch mechanism so that the vehicle door is permitted to open from the vehicle body, and a lock position, which disables the transmission of the movement of the inside open lever and the operation force from outside the vehicle to the latch mechanism. The movable body is movable to an unset position, which enables transmission of movement of the inside lever to the inside open lever when the locking lever is located at the unlock position, a set position, which disables the transmission of the movement of the inside lever to the inside open lever when the locking lever is located at the unlock position, and a double lock position, which disables the transmission of the movement of the inside lever to the inside open lever when the locking lever is located at the lock position. The switching lever is linked to the movable body and driven by the electrical drive unit to move the movable body. The first engagement piece is arranged on the locking lever, and the second engagement piece is arranged on the switching lever. When the locking lever is located at the unlock position, the second engagement piece engages with the first engagement piece located at the set position of the movable body to limit movement of the switching lever so that movement of the movable body is restricted within a range between the unset position and the set position. When the locking lever is located at the lock position, the first engagement piece is arranged at a position avoiding engagement with the second engagement piece to allow the switching lever to move the movable body between the unset position and the double lock position.

One aspect of the present invention further includes a middle lever connected to the vehicle door and slidably supporting the movable body. The movable body is pushed by the switching lever as the switching lever moves thereby moving between the unset position, the set position, and the double lock position while sliding the middle lever.

In the above structures, when the locking lever is located at the unlock position, the first and second engagement pieces are engaged so that movement of the switching lever caused by the driving force of the electrical drive unit is mechanically restricted. This allows for arrangement of the movable body at the set position. When the locking lever is located at the lock position, the first and second engagement pieces are disengaged so as to allow the driving force of the electrical drive unit to move the switching lever. Thus, the movable body is moved to and arranged at the double lock position. In this manner, the movable body may be selectively moved to and arranged at the set position and the double lock position with the driving force of the single electrical drive unit in accordance with the engagement and disengagement of the switching lever corresponding to the unlock position and the lock position of the locking lever. This eliminates the need for a sensor or the like for detecting, for example, that the movable body is located at the set position (or a corresponding state of the switching lever) and allows the electrical structure to be simplified. Further, when arranging the movable body at the set position, to mechanically stop the movement of the switching lever, positional variations of the movable body are reduced in comparison to, for example, when detecting that the movable body is located at the set position using a sensor or the like. This improves the reliability of the entire device.

In one aspect of the present invention, the middle lever is linked to the inside lever by the movable body when the movable body is located at the set position so as to move integrally with the inside lever, and the middle lever includes a pushing piece. The door lock device further includes a release lever linked to the locking lever, in which the release lever is pushed by the pushing piece as the inside lever moves when the locking lever moves to the lock position in a state in which the movable body is located at the set position and thereby operates to move the locking lever to the unlock position.

In this structure, when the locking lever is moved to the lock position in a state in which the movable body is located at the set position, the input of an operation force from the inside of the vehicle moves the inside lever and pushes the release lever with the pushing piece of the middle lever, which moves integrally with the inside lever. This allows for the locking lever to be moved to the unlock position.

In one aspect of the present invention, the release lever is pushed by the pushing piece as the inside lever moves when the movable body is located at the unset position and the locking lever is located at the lock position and thereby operates to move at least the locking lever to the unlock position.

In this structure, when the movable body is located at the unset position and the locking lever is located at the lock position, the release lever is pushed by the pushing piece of the middle lever, which moves integrally with the inside lever, and functions to move at least the locking lever to the unlock position (the so-called two-motion or one motion-function). This allows for the number of components to be reduced in comparison to when using, for example, a discrete exclusive member (lever or the like) having such a function.

In one aspect of the present invention, the inside lever, the inside open lever, and the middle lever are supported by the vehicle door rotatably about the same axis.

In this structure, the urging member selectively urges and holds the switching lever. This stably holds the movable body at the unset position, the set position, and the double lock position.

One aspect of the present invention further includes an urging member that selectively holds the switching lever to hold the movable body at the unset position, the set position, and the double lock position.

In one aspect of the present invention, the switching lever is selectively switched to pivotal positions corresponding to the unset position, set position, or double lock position of the movable body in accordance with the unlock position or lock position of the locking lever by a drive force of the electrical drive unit and an urging force of the urging member.

In one aspect of the present invention, the urging member is a restraining spring.

In one aspect of the present invention, the first engagement piece is arranged in a movement path of the second engagement piece when the locking lever is located at the unlock position, and the first engagement piece is arranged outside the movement path of the second engagement piece when the locking lever is located at the lock position.

In one aspect of the present invention, the movable body is movable, via the set position, between the unset position and the double lock position.

DETAILED DESCRIPTION OF THE PREFERRED EMBODIMENTS

One embodiment of the present invention will now be discussed with reference to the drawings.

Figure 1:
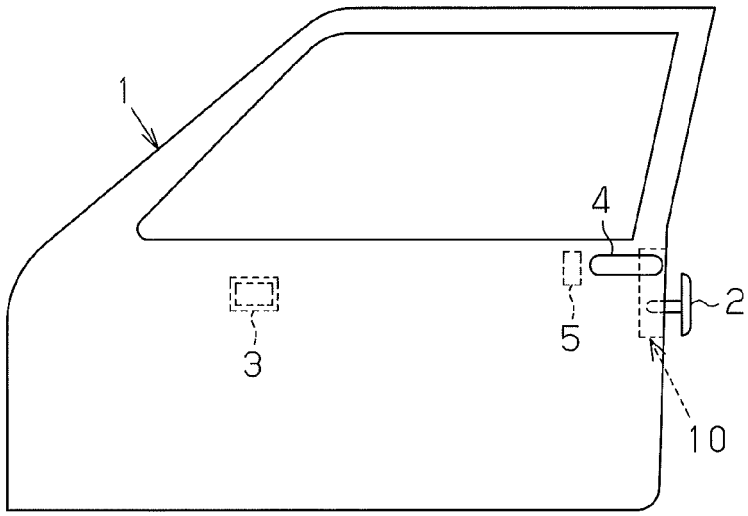
FIG. 1 is a front view showing a vehicle door to which a door lock device according to one embodiment of the present invention is applied.

Referring to FIG. 1, a vehicle door 1 includes a door lock device 10, which is arranged along the rear rim of the vehicle door 1. The door lock device 10 is engaged with a striker 2, which is fixed to a vehicle body (not shown), to hold the vehicle door 1 in a closed state with respect to the vehicle body. Further, an inside handle 3 is arranged on an inner wall of the vehicle door 1 in a state exposed in the passenger compartment. An outside handle 4 is arranged on an outer wall of the vehicle door 1 in a state exposed to the outside of the vehicle compartment. Further, a lock knob 5, which is used for locking, is arranged on the inner wall of the vehicle door 1. To prevent theft, the lock knob 5 of the present embodiment is designed to be held within the vehicle door 1 in a locked state so as to prohibit direct operation.

Figure 2:
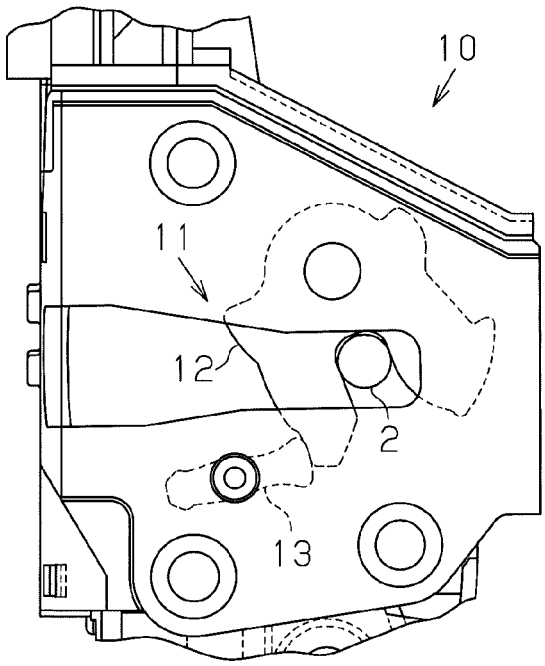
FIG. 2 is a plan view showing a latch mechanism in the door lock device of FIG. 1.

As shown in FIG. 2, the door lock device 10 includes a latch mechanism 11. The latch mechanism 11 includes a latch 12 and a pole 13. The latch mechanism 11 engages the striker 2 to hold the vehicle door 1 in a closed state with respect to the vehicle body. When closing the vehicle door, the latch 12 rotates in a first direction and engages the striker 2. Further, the pole 13 engages the latch 12 to hinder rotation of the latch 12 and thereby hold the vehicle door 1 in a closed state. When the pole 13 is rotated so as to allow for rotation of the latch 12, an urging force of a recovery spring, which is not shown, rotates the latch 12 in a second direction, which is opposite the first direction. This releases the engagement of the latch 12 and the striker 2, and the vehicle door 1 is permitted to open from the vehicle body.

Figure 3:
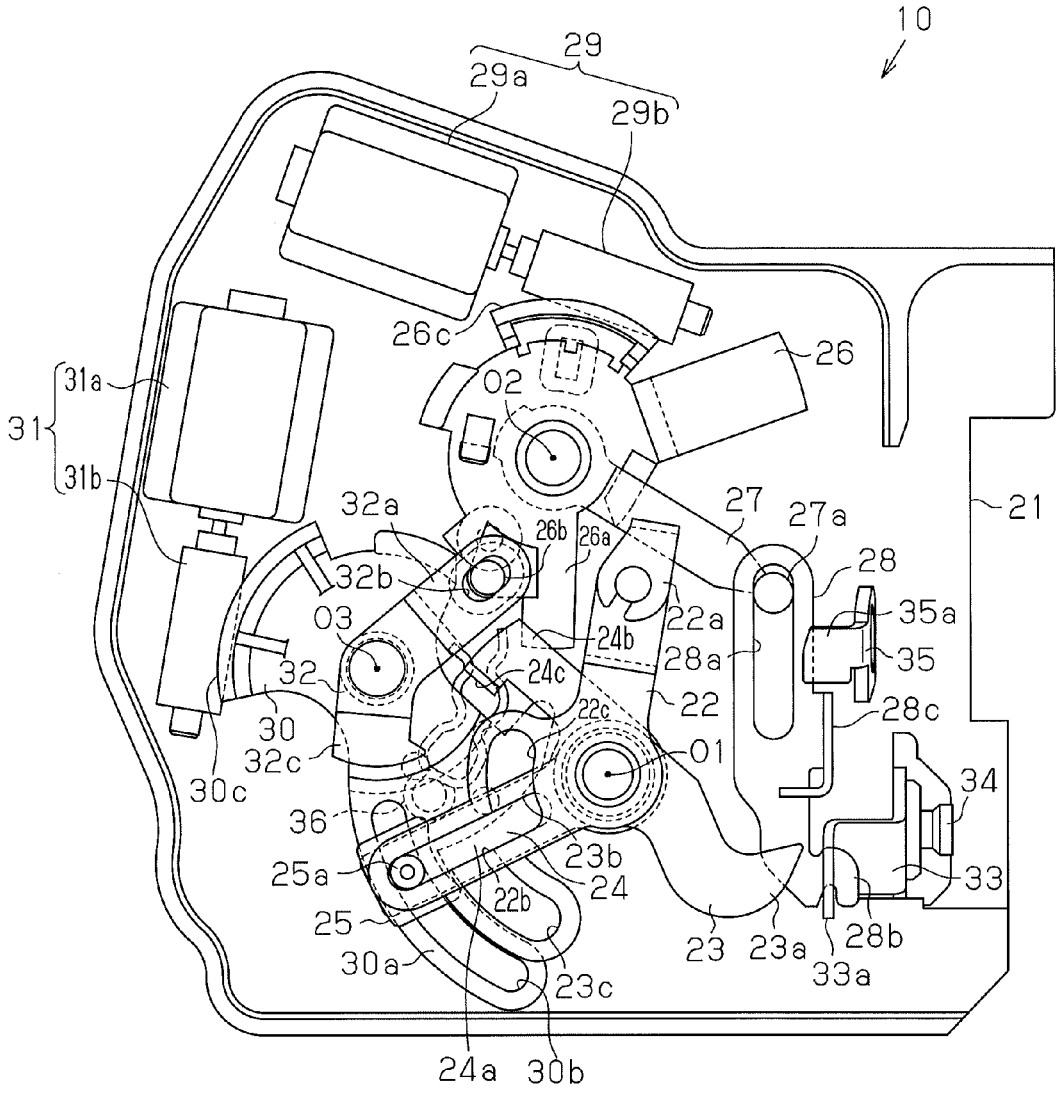
FIG. 3 is a side view showing the operation of the door lock device of FIG. 1.

The door lock device 10 will now be described in detail with reference to FIGS. 3 to 8. FIG. 3 shows the vehicle door 1 in an unlock state in which the vehicle door 1 is permitted to open by operating the inside handle 3. The state of the door lock device 10 shown in FIG. 3 is referred to as an unset state.

As shown in FIG. 3, the door lock device includes a box-shaped housing 21 and an activation mechanism. The activation mechanism includes an inside lever 22, an inside open lever 23, a middle lever 24, a bushing 25 serving as a movable body, an active lever 26 serving as a locking lever, a panic lever 27, an open link 28, a lock actuator 29, a switching lever 30, a switching actuator 31 serving as an electrical drive unit, and a release lever 32. That is, the activation mechanism is accommodated in the housing 21 and thereby unitized.

The inside lever 22 is formed by, for example, a metal plate and supported to be pivotal in the clockwise direction and the counterclockwise direction as viewed in the drawing relative to the housing 21 about a rotary axis O1 when arranged at a predetermined initial pivotal position. The inside lever 22 includes a distal portion extending upward, as viewed in the drawing, and folded back toward the rotary axis O1 to form a scissor-shaped hooking piece 22*a*. The inside lever 22, which is linked to the inside handle 3 by the hooking piece 22*a*, is pivoted in the counterclockwise direction as viewed in FIG. 3 by performing an opening operation with the inside handle 3. The inside lever 22 includes an elongated engagement hole 22*b*, which extends in the radial direction toward one side of the rotary axis O1 (toward the lower left side of FIG. 3), and a circumferential hole 22*c*, which extends in the clockwise direction as viewed in the drawing in the circumferential direction about the rotary axis O1 continuously from the basal end of the engagement hole 22*b*.

The inside open lever 23 is formed by, for example, a metal plate, arranged at the lower side of the inside lever 22 as viewed in a direction perpendicular to the plane of the drawing, and supported to be pivotal in the clockwise direction and the counterclockwise direction as viewed in the drawing relative to the housing 21 about the rotary axis O1. The inside open lever 23 includes a pawl-shaped pushing piece 23*a*, which extends in the radial direction toward one side of the rotary axis O1 (toward the lower right side of FIG. 3), an engagement hole 23*b*, and a circumferential hole 23*c*. The engagement hole 23*b* has the shape of an elongated hole and extends in the radial direction toward another side of the rotary axis O1 (toward the lower left side of FIG. 3). The circumferential hole 23*c* is continuous with a middle position of the engagement hole 23*b* in the longitudinal direction and extends in the counterclockwise direction along the circumferential direction about the rotary axis O1. The engagement hole 23*b* has a shape that is similar to that of the engagement hole 22*b* of the inside lever 22.

The middle lever 24 is formed by, for example, a metal plate, arranged at the lower side of the inside open lever 23 as viewed in a direction perpendicular to the plane of the drawing and supported to be pivotal in the clockwise direction and the counterclockwise direction as viewed in the drawing relative to the housing 21 about the rotary axis O1. The middle lever 24 includes a guide piece 24*a*, which is elongated and extends in the radial direction toward one side of the rotary axis O1 (toward the lower right side of FIG. 3), and an extension piece 24*b*, which extends in the radial direction toward another side of the rotary axis O1 (toward the upper left side of FIG. 3). The extension piece 24*b* includes a distal portion extending in the counterclockwise direction as viewed in the drawing along the circumferential direction about the rotary axis O1, and the distal portion forms a pushing piece 24*c*. The guide piece 24*a* has an extension length that is set to be longer than the lengths of the engagement holes 22*b* and 23*b*.

The bushing 25 is formed from, for example, a resin material and has the shape of a planar plate. The bushing 25 is supported to be slidable in the longitudinal direction (radial direction) of the guide piece 24*a*. The bushing 25 includes a cylindrical engagement projection 25*a*, which projects toward the upper side and the lower side as viewed in a direction perpendicular to the plane of the drawing. When the bushing 25 is arranged at a predetermined position at a distal side (the side farer from the rotary axis O1) of the guide piece 24*a*, the engagement projection 25*a* is inserted into the two engagement holes 22*b* and 23*b*. As a result, the bushing 25 restricts relative movement of the inside lever 22 and the inside open lever 23 in the circumferential direction about the rotary axis O1. In this state, the bushing 25 is capable of transmitting the pivoting force of the inside lever 22 to the inside open lever 23 and the middle lever 24, and the position of the bushing 25 in this state is referred to as the unset position.

Figure 6:
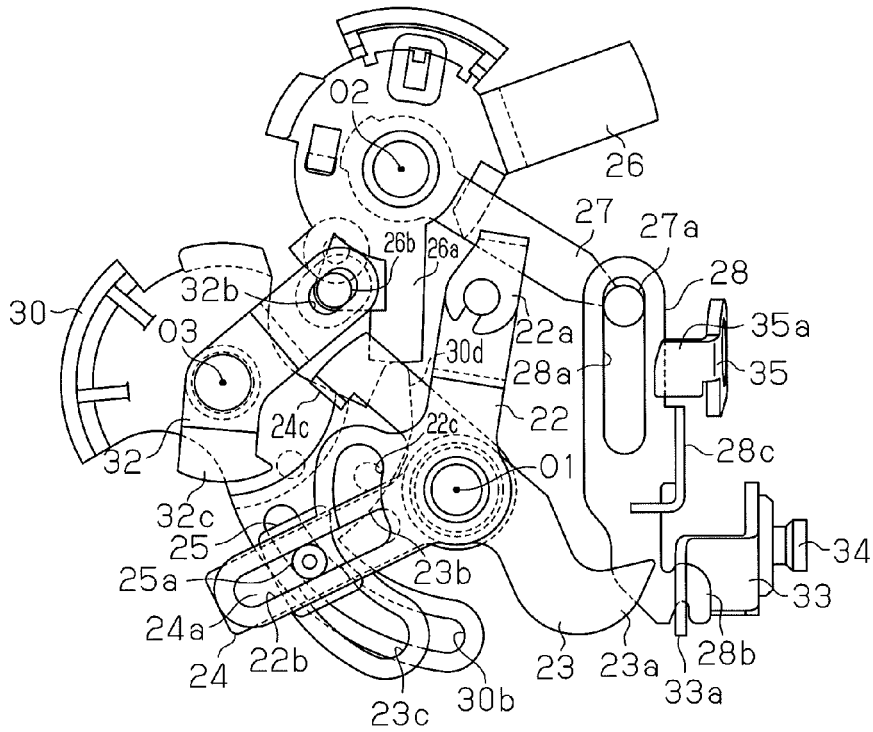
FIG. 6 is a side view showing the operation of the door lock device of FIG. 1.

Further, as shown in FIG. 6, when the bushing 25 is arranged at a predetermined position at the middle part of the guide piece 24*a* in the longitudinal direction, the engagement projection 25*a* faces toward the circumferential hole 23*c* of the inside open lever 23 along the circumferential direction about the rotary shaft O1. This cancels the restriction of the relative movement of the bushing 25 with respect to the inside open lever 23. In this state, the bushing 25 is not capable of transmitting the pivoting force of the inside lever 22 to the inside open lever 23 and thereby capable of transmitting the pivoting force to only the middle lever 24. The position of the bushing 25 in this state is referred to as the set position.

Figure 7:
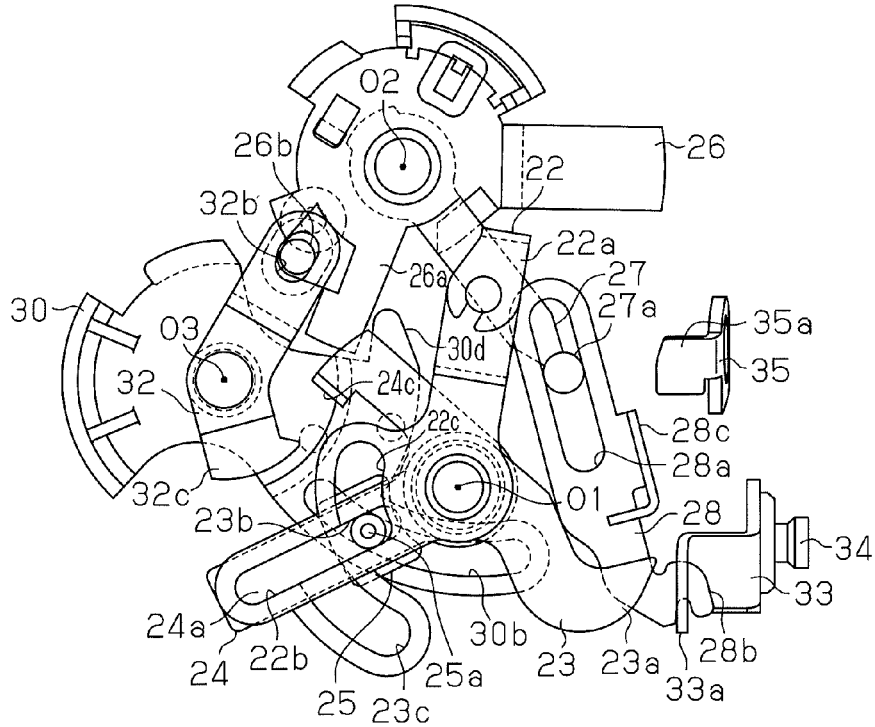
FIG. 7 is a side view showing the operation of the door lock device of FIG. 1.

As shown in FIG. 7, when the bushing 25 is arranged at a predetermined position at a side of the guide piece 24*a* closer to the rotary axis O1, the engagement projection 25*a* faces toward the circumferential hole 22*c* of the inside lever 22 along the circumferential direction about the rotary shaft O1. This cancels the restriction of the relative movement of the bushing 25 with respect to the inside lever 22. In this state, the bushing 25 is not capable of transmitting the pivoting force of the inside lever 22 to the inside open lever 23 and the middle lever 24. The position of the bushing 25 in this state is referred to as the double lock position.

In this manner, the bushing 25 moves along the guide piece 24*a* to selectively switch states in which the inside lever 22, the inside open lever 23, and the middle lever 24 are integrally rotatable and relatively rotatable.

Figure 4:
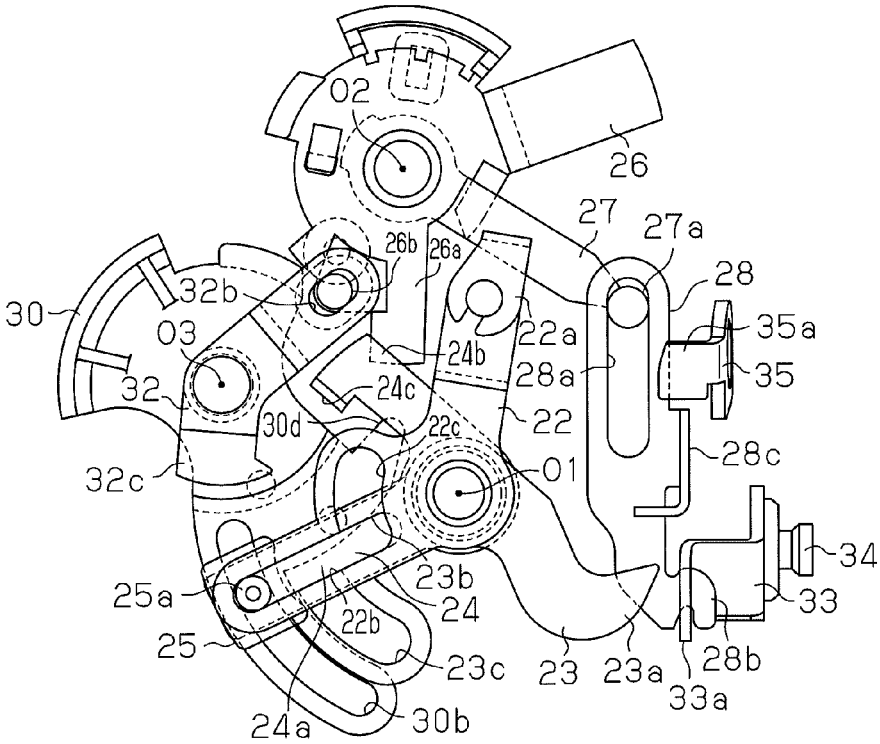
FIG. 4 is a side view showing the operation of the door lock device of FIG. 1.
Figure 5:
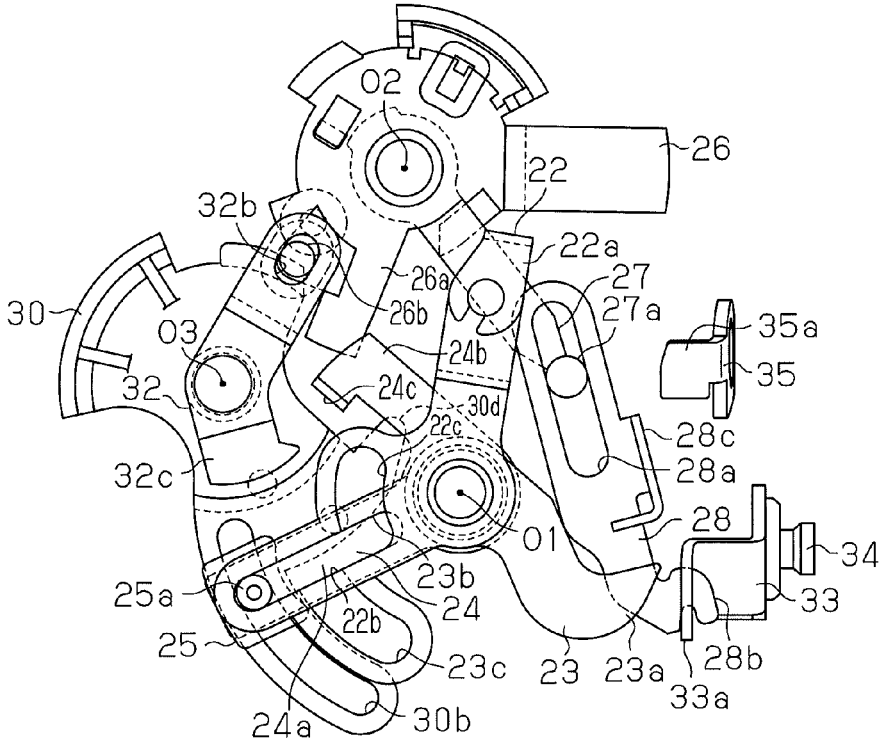
FIG. 5 is a side view showing the operation of the door lock device of FIG. 1.

The active lever 26 is molded from, for example, a resin material and arranged at the lower side of the middle lever 24 as viewed in a direction perpendicular to the plane of the drawing. The active lever 26 is supported to be pivotal in the clockwise direction and the counterclockwise direction as viewed in the drawing relative to the housing 21 about a rotary axis O2, which is parallel to the rotary axis O1. Further, the active lever 26 is restricted by the housing 21 so as to pivot in a predetermined pivotal range. The pivotal position of the active lever 26 in which pivoting is restricted in the counterclockwise direction as viewed in FIGS. 3, 4, and 6 is referred to as the unlock position. The pivotal position of the active lever 26 in which pivoting is restricted in the clockwise direction as viewed in FIGS. 5 and 7 is referred to as the lock position. A spring, which is not shown, is attached to the housing 21 to position the active lever 26. The active lever 26 is urged by the spring and selectively switched and held at the unlock position and the lock position.

The active lever 26 includes a first engagement piece 26*a*, which is elongated and extends in the radial direction toward one side of the rotary axis O2 (toward the lower side of FIG. 3), a connecting projection 26*b*, which is adjacent to the basal portion of the first engagement piece 26*a* and projects toward the upper side as viewed in a direction perpendicular to the plane of the drawing, and a gear 26*c*, which is fan-shaped and extends from the rotary shaft O2 toward the lock actuator 29. The lock actuator 29 includes an electric motor 29*a* and an output gear 29*b*, which is fixed to a rotary shaft of the electric motor 29*a*. The gear 26*c* of the active lever 26 meshes with the output gear 29*b* of the lock actuator 29. The urging force of the spring and the driving of the actuator 29 switches the active lever 26 between the unlock position and the lock position.

The panic lever 27 is formed by, for example, a metal plate and supported to be pivotal in the clockwise direction and the counterclockwise direction as viewed in the drawing relative to the housing 21 about the rotary axis O2. An urging member, which is not shown, is wound around the rotary axis O2. The basal end of the urging member is hooked to the active lever 26, and the distal end of the urging member is hooked to the panic lever 27. The panic lever 27 is basically supported to pivot integrally with the active lever 26. A hooking pin 27*a* attached to the distal portion of the panic lever 27 projects toward the upper side as viewed in a direction perpendicular to the plane of the drawing.

The open link 28 is formed by, for example, a metal plate and extends in the vertical direction as viewed in FIG. 3. An engagement groove 28*a*, into which the hooking pin 27*a* of the panic lever 27 is inserted and which has the shape of an elongated hole, is formed in a first end portion of the open link 28. The open link 28 is connected to the panic lever 27 so that the panic lever 27 is movable in the longitudinal direction of the engagement groove 28*a*.

A connecting portion 28*b*, which is connected to the open lever 33 further connected to the housing 21, is formed in a second end portion of the open link 28. The open link 28 is swingable relative to the open lever 33. The open lever 33 is pivotally attached to the housing 21 by a support pin 34. The open lever 33 is pivotally attached to the housing 21 by a support pin 34, and the support pin 34 is stably arranged at a predetermined pivotal position on the housing 21 by a torsion spring, which is not shown. The open lever 33 has a first end portion 33*a*, which is connected to the connecting portion 28*b* of the open link 28, and a second end portion, which is located on the opposite side of the first end portion 33*a* with a pivot center located therebetween and linked to the outside handle 4. When the outside handle 4 undergoes an opening operation, the open lever 33 pivots so as that the first end portion 33*a*, namely, the open link 28, is moved in the upward direction countering the torsion spring.

Further, the open link 28 includes an L-shaped engagement piece 28*c*, which is located between the engagement groove 28*a* and the connecting portion 28*b*. The engagement piece 28*c* is arranged near a lift lever 35, which is pivotally attached to the housing 21. The lift lever 35 is connected to the pole 13 shown in FIG. 2 so as to pivot integrally with the pole 13. The lift lever 35 includes a distal portion 35*a*, which faces toward the engagement piece 28*c*. When the lift lever 35 pivots so as to move the distal portion 35*a* in the upward direction, the engagement of the latch 12 and the striker 2 is released, and the vehicle door 1 is permitted to open from the vehicle body.

The engagement piece 28*c* is arranged so as to face toward the pushing piece 23*a* of the inside open lever 23 in the vertical direction. In other words, the engagement piece 28*c* is arranged on a pivot path of the pushing piece 23*a*. Accordingly, when, for example, the inside open lever 23 is pivoted in the counterclockwise direction as viewed in FIG. 3, the pushing piece 23*a* pushes an end face of the engagement piece 28*c* toward the upper side. This moves the open link 28 in the upward direction.

The positional relationship of the engagement piece 28*c* and the distal portion 35*a* in correspondence with the unlock position and lock position of the active lever 26 will now be described. As shown in the states of FIGS. 3 and 4, when the active lever 26 is located at the unlock position, the hooking pin 27*a* of the panic lever 27 guides the first end portion of the open link 28 to one side (right side as viewed in FIGS. 3 and 4). In this state, the engagement piece 28*c* and the distal portion 35*a* are arranged facing toward each other in the vertical direction, and the engagement groove 28*a* is also arranged so that its longitudinal direction is aligned with the vertical direction. Accordingly, when the open link 28 (engagement piece 28*c*) is moved in the upward direction as described above, the distal portion 35*a* is pushed by the engagement piece 28*c* and moved in the upward direction. This releases the engagement of the latch 12 and the striker 2.

As shown in the state of FIG. 5, when the active lever 26 is located at the lock position, the hooking pin 27*a* of the panic lever 27 guides the first end portion of the open link 28 to the other side (left side as viewed in FIG. 5). In this state, the engagement piece 28*c* is arranged so that an extension line extending along the longitudinal direction of the engagement groove 28*a* is separated from the distal portion 35*a*. Accordingly, even if the open link 28 moves upward, the engagement piece 28*c* does not push and move the distal portion 35*a* in the upward direction, and the latch 12 and striker 2 remain engaged.

The lock actuator 29 is drive-controlled for a fixed period when a control circuit, which is not shown, detects a remote operation (lock-unlock operation) of a lock-unlock switch arranged on a key blade or a door interior trim. The driving of the lock actuator 29 selectively switches the active lever 26 to the unlock position and the lock position. The active lever 26 is linked to the lock knob 5, and operation (manual operation) of the lock knob 5 also allows for switching from the unlock position to the lock position. However, after being switched to the lock position (after locking), the lock knob 5 is held within the vehicle door 1 so as to prohibit direction operation. Thus, the lock knob 5 cannot be operated to switch the active lever 26 from the lock position to the unlock position.

The switching lever 30 is formed from, for example, a resin material and arranged at the lower side of the middle lever 24 as viewed in a direction perpendicular to the plane of the drawing at a position overlapping the active lever 26 in the axial direction. The switching lever 30 is supported to be pivotal in the clockwise direction and the counterclockwise direction as viewed in the drawing relative to the housing 21 about a rotary axis O3, which is parallel to the rotary axes O2. Further, the switching lever 30 is restricted by the housing 21 so as to pivot in a predetermined pivotal range.

The switching lever 30 includes a plate-shaped lever portion 30*a*, which extends toward the bushing 25 from the pivot center. The lever portion 30*a* includes an arcuate guide hole 30*b*, which generally extends in the radial direction relative to the rotary axis O3, and a gear 30*c*, which is fan-shaped and extends from the rotary shaft O3 toward the switching actuator 31. The engagement projection 25*a*, which projects toward the lower side as viewed in a direction perpendicular to the plane of the drawing, is inserted into the guide hole 30*b*. Accordingly, the guide hole 30*b* restricts movement of the engagement projection 25*a* in the radial direction about the rotary axis O1. This restricts the position of the bushing 25 on the guide piece 24*a*. Further, as shown in FIG. 4, the switching lever 30 includes a second engagement piece 30*d*, which projects toward the active lever 26 (first engagement piece 26*a*) along the circumferential direction about the rotary axis O3 from near the basal portion of the lever portion 30*a*.

As shown in the states of FIGS. 3 to 5, when the housing 21 restricts pivoting of the switching lever 30 in the clockwise direction as viewed in the drawing, the bushing 25, the position of which is restricted by the switching lever 30 (guide hole 30*b*), is arranged at the unset position. As shown in FIGS. 4 and 6, when the active lever 26 is located at the unlock position, the first engagement piece 26*a* is arranged on the pivot path of the second engagement piece 30*d* in the counterclockwise direction as viewed in the drawing, and the direction in which load is input to the first engagement piece 26*a* from the second engagement piece 30*d* during abutment coincides with the radial direction about the rotary axis O2.

Accordingly, when the active lever 26 is located at the unlock position, the second engagement piece 30*d* abuts against the first engagement piece 26*a* and restricts pivoting of the switching lever 30 in the counterclockwise direction as viewed in the drawing. In this state, the bushing 25 of which position is restricted by the switching lever 30 (guide hole 30*b*) is arranged at the set position.

Further, as shown in FIGS. 5 and 7, when the active lever 26 is located at the lock position, the first engagement piece 26*a* is separated from the pivot path of the second engagement piece 30*d* in the counterclockwise direction as viewed in the drawing. As shown in the state of FIG. 7, when the housing 21 restricts pivoting of the switching lever 30 in the counterclockwise direction as viewed in the drawing and avoids the first engagement piece 26*a*, the bushing 25 of which position is restricted by the switching lever 30 (guide hole 30*b*) is arranged at the double lock position.

The switching actuator 31 includes an electric motor 31*a* and an output gear 31*b*, which is fixed to a rotary shaft of the electric motor 31*a*. The gear 30*c* of the switching lever 30 connects and meshes with the output gear 31*b* of the switching actuator 31. When the active lever 26 is located at the unlock position, the switching lever 30 is driven by the switching actuator 31 and selectively switches the bushing 25 between the unset position and the set position. Further, when the active lever 26 is located at the lock position, the switching lever 30 is driven by the switching actuator 31 and selectively switches the bushing 25 between the unset position (or set position) and the double lock position. As shown in FIG. 3, a restraining spring 36, which serves as an urging member for positioning the switching lever 30, is attached to the housing 21. The switching lever 30 is urged by the restraining spring, and the bushing 25 is selectively switched and held between pivotal positions defining the unset position, the set position, and the double lock position.

The switching actuator 31 is drive-controlled for a fixed period when a control circuit, which is not shown, detects a remote operation of a switching switch arranged on a key blade or a door interior trim. The driving force of the switching actuator 31 and the urging force of the restraining spring 36 selectively switch the switching lever 30 to pivotal positions corresponding to the unset position, the set position, and the double lock position of the bushing 25 in accordance with the position of the active lever 26 (unlock position or lock position). Part of the switching lever 30 serving as an operation unit is exposed to the outer side of the vehicle door 1 (e.g., door joining surface). Operation (manual operation) of the operation unit also switches the switching lever 30 to the pivotal position corresponding to the unset position or set position of the bushing 25.

The release lever 32 is formed by, for example, a metal plate and arranged at the upper side of the switching lever 30 (and active lever 26) as viewed in a direction perpendicular to the plane of the drawing at a position overlapping the middle lever 24 in the axial direction. The release lever 32 includes a connecting piece 32*a*, which is plate shaped and extends in the radial direction toward one side of the rotary axis O3 (toward the upper right side of FIG. 3, that is, toward the active lever 26). An elongated hole 32*b* in which the connecting projection 26*b* is inserted is formed in the distal portion of the connecting piece 32*a*. The release lever 32 further includes an abutment piece 32*c*, which has the shape of an ice ax and extends in the radial direction toward another side of rotary shaft O3 (lower side of FIG. 3).

The release lever 32 and the active lever 26, which are connected by the elongated hole 32*b* and the connecting projection 26*b* that is inserted into the elongated hole 32*b*, are connected so as to rotate integrally about their rotary axes. Accordingly, for example, when the active lever 26 pivots between the unlock position and the lock position about the rotary axis O2, the release lever 32 cooperatively pivots about the rotary shaft O3. Alternatively, when the release lever 32 pivots about the rotary axis O3, the active lever 26 cooperatively pivots about the rotary axis O2. In this state, the active lever 26 is selectively switched to the unlock position and the lock position countering the above-described positioning spring.

Figure 8:
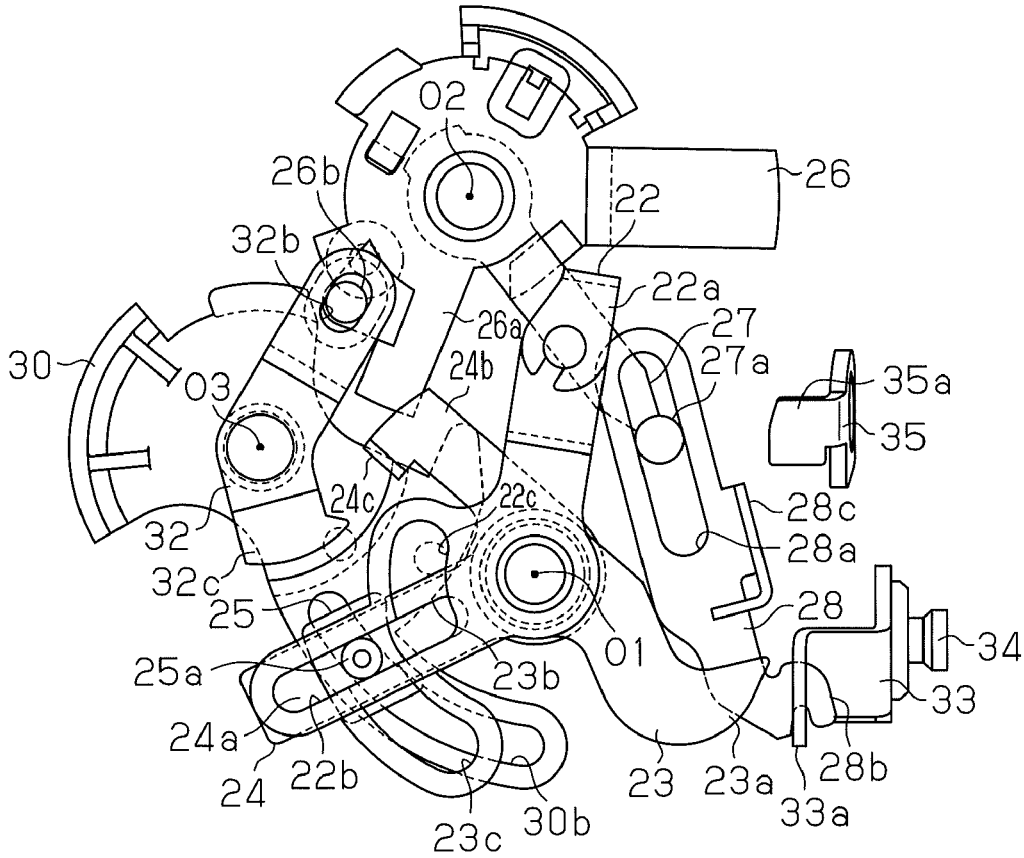
FIG. 8 is a side view showing the operation of the door lock device of FIG. 1.

As shown in FIGS. 3, 4, and 6, when the active lever 26 is located at the unlock position, the abutment piece 32*c* of the release lever 32, which cooperates with the active lever 26, is set to move away from the pivot path of the pushing piece 24*c* extending in the counterclockwise direction as viewed in the drawing. Accordingly, the middle lever 24 and the release lever 32 do not cooperate. As shown in FIGS. 5 and 8, when the active lever 26 is located at the lock position, the abutment piece 32*c* of the release lever 32 is set to be arranged in the pivot path of the pushing piece 24*c* extending in the counterclockwise direction as viewed in the drawing. Accordingly, when operation of the inside handle 3 pivots the middle lever 24 integrally with the inside lever 22 in the counterclockwise direction as viewed in the drawing, the pushing piece 24*c* pushes the abutment piece 32*c*. Thus, the active lever 26 is pivoted in cooperation with the release lever 32 in the counterclockwise direction as viewed in the drawing and moved (returned) to the unlock position.

The entire operation of the present embodiment will now be discussed.

As shown in FIG. 4, in a state in which the active lever 26 is located at the unlock position and the bushing 25 is located at the unset position (unlock state, unset state), when the inside handle 3 is operated in the opening direction, the inside lever 22 is pivoted in the counterclockwise direction as viewed in the drawing. This integrally pivots the middle lever 24, which supports the bushing 25 that is hooked to the engagement hole 22*b*, with the inside lever 22 and integrally pivots the inside open lever 23, which includes the engagement hole 23*b* hooked with the engagement projection 25*a*, with the inside lever 22. Thus, the pushing piece 23*a* pushes the engagement piece 28*c* of the open link 28. In this state, the engagement piece 28*c* of the open link 28 and the distal portion 35*a* of the lift lever 35 are arranged facing toward each other in the vertical direction. This moves the distal portion 35*a* in the upward direction. Further, the engagement of the latch 12 and striker 2 is released. Operation of the outside handle 4 to move the first end portion 33*a* of the open lever 33 in the upward direction also releases the engagement of the latch 12 and striker 2.

As shown in FIG. 5, in a state in which the active lever 26 is located at the lock position and the bushing 25 is located at the unset position (lock state, unset state), when the inside handle 3 is operated in the opening direction, the inside lever 22 is pivoted in the counterclockwise direction as viewed in the drawing. This integrally pivots the middle lever 24, which supports the bushing 25 that is hooked to the engagement hole 22*b*, with the inside lever 22 and thereby pushes the abutment piece 32*c* of the release lever 32 with the pushing piece 24*c*. Thus, the active lever 26 is pivoted in cooperation with the release lever 32 in the counterclockwise direction and urged by the positioning spring to move (return) to the unlock position. Accordingly, in the present embodiment, even in the lock state, operation of the inside handle 3 in the opening direction allows for shifting (returning) to the unlock state.

When the inside handle 3 is further operated once, the inside open lever 23 is integrally pivoted in the counterclockwise direction as viewed in the drawings with the inside lever 22 and the middle lever 24. This moves the distal portion 35*a* of the lift lever 35 in the upward direction and releases the engagement of the latch 12 and the striker 2. In other words, in the lock state, two operations of the inside handle 3 operates the latch mechanism 11 so that the vehicle door 1 is permitted to open from the vehicle body (two-motion mechanism).

When the outside handle 4 is operated in the opening direction, the open link 28 moves in the upward direction. However, the extension line extending along the longitudinal direction of the engagement groove 28*a* is separated from the distal portion 35*a*. Thus, the engagement piece 28*c* does not push and move the distal portion 35*a* in the upward direction. Accordingly, the latch 12 and striker 2 remain engaged.

Further, in the state shown in FIG. 4 (unlock state, unset state), when the driving of the switching actuator 31 pivots the switching lever 30 in the counterclockwise direction as viewed in the drawing, the second engagement piece 30*d* of the switching lever 30 abuts against the first engagement piece 26*a* and restricts pivoting of the switching lever 30 as shown in FIG. 6. When the switching actuator 31 is deactivated, the switching lever 30 is held at its pivotal position by the urging force of the restraining spring 36, and the bushing 25 of which position is restricted by the switching lever 30 is arranged and held at the set position. In this state, the engagement projection 25*a* of the bushing 25 faces toward the circumferential hole 23*c* of the inside open lever 23, as described above. Accordingly, when the inside handle 3 is operated in the opening direction and the inside lever 22 is thereby pivoted in the counterclockwise direction as viewed in the drawing, the middle lever 24, which supports the bushing 25 hooked to the engagement hole 22*b*, is integrally pivoted. However, the inside open lever 23 is relatively rotatable. In this state, even when the inside handle 3 is operated in the opening direction to pivot the inside lever 22 (and middle lever 24) in the counterclockwise direction as viewed in the drawing, relative rotation of the inside lever 22 and the inside open lever 23 is permitted, and the inside lever 22 rotates freely without the inside open lever 23. In other words, when the bushing 25 is located at the set position, even when the inside handle 3 is operated, only the inside lever 22 and the middle lever 24 are pivoted. Obviously, the engagement of the latch 12 and striker 2 is not released. When the outside handle 4 is operated in the opening direction, the engagement piece 28*c* of the open link 28 and the distal portion 35*a* are arranged facing toward each other in the vertical direction. This releases the engagement of the latch 12 and striker 2.

Specifically, the state shown in FIG. 6 is the so-called child lock state that allows operation of the latch mechanism 11 so that the vehicle door 1 is permitted to open from the vehicle body only when operated from outside the vehicle (operation of the outside handle 4). In this state, when the driving of the switching actuator 31 pivots the switching lever 30 in the clockwise direction as viewed in the drawing, the switching lever 30 pivots until restricted by the housing 21 and returns to the state shown in FIG. 4.

Further, in the state shown in FIG. 5 (lock state, unset state), when the driving of the switching actuator 31 pivots the switching lever 30 in the counterclockwise direction as viewed in the drawing, the first engagement piece 26*a* moves away from the pivot path of the second engagement piece 30*d* in the counterclockwise direction. This pivots the switching lever 30 in the counterclockwise direction as viewed in the drawing until restricted by the housing 21. When the switching actuator 31 is deactivated, the switching lever 30 is held at its pivotal position by the urging force of the restraining spring 36, and the bushing 25 of which position is restricted by the switching lever 30 is arranged and held at the double lock position. In this state, the engagement projection 25*a* of the bushing 25 faces toward the circumferential hole 22*c* of the inside lever 22, as described above. Accordingly, relative rotation of the inside lever 22 and the middle lever 24, which supports the bushing 25, is allowed. In this state, even when the inside handle 3 is operated in the opening direction to pivot the inside lever 22 in the counterclockwise direction as viewed in the drawing, relative rotation of the inside lever 22 and the middle lever 24 is permitted, and the inside lever 22 rotates freely without the middle lever 24 and the inside open lever 23. In other words, when the bushing 25 is located at the double lock position, even when the inside handle 3 is operated, only the inside lever 22 is pivoted. Obviously, the engagement of the latch 12 and striker 2 is not released. Even when the outside handle 4 is operated in the opening direction, the extension line extending along the longitudinal direction of the engagement groove 28*a* in the open link 28 is separated from the distal portion 35*a*. Thus, the latch 12 and striker 2 remain engaged. In other words, the state shown in FIG. 7 is the so-called double lock state that prohibits operation of the latch mechanism 11 so that the vehicle door 1 cannot open the vehicle body when operated from inside and outside the vehicle (operation of the inside handle 3 and outside handle 4). In this state, when the driving of the switching actuator 31 pivots the switching lever 30 in the clockwise direction as viewed in the drawing, the switching lever 30 pivots until restricted by the housing 21 and returns to the state shown in FIG. 5.

In the state shown in FIG. 6 (child lock state), for example, erroneous operation (manual operation) of the lock knob 5 may switch the active lever 26 from the unlock position to the lock position as shown in the state of FIG. 8. In this case, the lock knob 5 is held within the vehicle door 1. Thus, the active lever 26 cannot be switched from the lock position to the unlock position by operating the lock knob 5. However, when the inside handle 3 is operated in the opening direction to pivot the inside lever 22 in the counterclockwise direction as viewed in the drawing, the middle lever 24, which supports the bushing 25 hooked to the engagement hole 22*b*, is integrally pivoted with the inside lever 22. This pushes the abutment piece 32*c* of the release lever 32 with the pushing piece 24*c*. As a result, the active lever 26 cooperates with the release lever 32 and pivots in the counterclockwise direction as viewed in the drawing. The active lever 26 is urged by the positioning spring and moved (returned) to the unlock position. Accordingly, in the present embodiment, even when the lock knob 5 is held within the vehicle door 1 in the child lock state, operation of the inside handle 3 in the opening direction allows for shifting (returning) to the child lock state. Particularly, when driving is disabled due to a failure in lock actuator 29 or the switching actuator 31, operation of the inside handle 3 allows for forcible shifting to the child lock state.

As discussed above in detail, the present embodiment has the advantages described below.

(1) When the active lever 26 is located at the unlock position, the first and second engagement pieces 26*a* and 30*d* are engaged so that the movement of the switching lever 30 caused by the driving force of the switching actuator 31 is mechanically restricted. This arranges the bushing 25 at the set position. When the active lever 26 is located at the lock position, the first and second engagement pieces 26*a* and 30*d* are disengaged so that the movement of the switching lever 30 caused by the driving force of the switching actuator 31 is permitted. This allows for the bushing 25 to be moved to the double lock position.

In this manner, in accordance with the engagement and disengagement of the switching lever 30 in correspondence with the unlock position and lock position of the active lever 26, the bushing 25 may be moved selectively to the set position and the double lock position by the driving force of the single switching actuator 31. This eliminates the need for sensors such as one that detects that the bushing 25 is located at the set position (or a corresponding sate of the switching lever 30) and thereby allows for the electrical structure to be simplified and reduces costs. Further, when arranging the bushing 25 at the set position, the movement of the switching lever 30 is mechanically restricted. This reduces positional variations of the bushing 25 in comparison to when detecting that the bushing 25 is located at the set position with a sensor or the like, for example. As a result, the reliability of the entire device is improved.

(2) When the active lever 26 is moved to the lock position in a state in which the bushing 25 is located at the set position, an input of operation force from inside the vehicle may move the inside lever 22. This pushes the release lever 32 with the pushing piece 24*c* of the middle lever 24, which moves integrally with the inside lever 22, and moves the active lever 26 to the unlock position. Particularly, even in a structure that hides the lock knob 5, movement of the inside lever 22 caused by an input of operation force from inside the vehicle allows for movement of the active lever 26 to the unlock position.

(3) When the bushing 25 is located at the unset position and the active lever 26 is located at the lock position, the release lever 32 is pushed by the pushing piece 24*c* of the middle lever 24, which moves integrally with the inside lever 22, and also functions to move the active lever 26 to the unlock position (two-motion function). Accordingly, the number of components may be reduced in comparison to, for example, when using a discrete exclusive member (lever or the like) having such a function.

(4) The inside lever 22, the inside open lever 23, and the middle lever 24 are coaxially connected to one another pivotally about the rotary shaft O1. This saves layout space and allows for a more compact size in entirety.

(5) The urging force of the restraining spring 36 selectively holds the switching lever 30. This stably holds the bushing 25 at the unset position, the set position, and the double lock position.

(6) For example, when the bushing 25 is located at the unset position, the bushing 25 may be moved to the set position or the double lock position in accordance with the position (unlock position or lock position) of the active lever 26 just by driving the switching actuator 31 continuously over a fixed period.

The embodiment discussed above may be modified as described below.

In the above-discussed embodiment, the active lever (first engagement piece 26*a*), which engages with the second engagement piece 30*d*, is used to restrict pivoting of the switching lever 30, which arranges the bushing 25 at the set position. However, the pivoting may be restricted by the panic lever 27 or the open link 28.

The above-discussed embodiment has a structure (two-motion structure) for performing in stages, during the lock state, the shifting to the unlock state by operating the inside handle 3 twice in the opening direction and the releasing of the engagement of the latch 12 and striker 2. Instead, a structure (one-motion structure) may be employed for sequentially performing the shifting to the unlock position by operating the inside handle 3 once in the opening direction and releasing of the engagement of the latch 12 and striker 2.

The two-motion mechanism (pushing piece 24*c*, release lever 32, and the like) may be eliminated.

An electromagnetic solenoid may be used as the drive unit of the lock actuator 29 or the switching actuator 31.

The invention claimed is:

1. A door lock device for a vehicle comprising:

a latch mechanism that holds a vehicle door in a closed state with respect to a vehicle body;

an inside lever operable from a passenger compartment of the vehicle;

an inside open lever operatively linked to the inside lever, and to the latch mechanism via an open link and a lift lever to release the vehicle door from the closed state held by the latch mechanism by causing the open link to move the lift lever;

a locking lever freely switchable to an unlock position, which enables transmission of movement of the inside open lever and which permits an operation force from a handle outside the vehicle and operatively connected to the open link to move the lift lever via the open link to operate the latch mechanism so that the vehicle door is permitted to open with respect to the vehicle body, and a lock position, which disables the transmission of the movement of the inside open lever and which does not permit the operation force from the handle outside the vehicle to move the lift lever via the open link;

a movable body movable to an unset position, which enables transmission of movement of the inside lever to the inside open lever when the locking lever is located at the unlock position, a set position, which disables the transmission of the movement of the inside lever to the inside open lever when the locking lever is located at the unlock position, and a double lock position, which disables the transmission of the movement of the inside lever to the inside open lever when the locking lever is located at the lock position;

an electrical drive unit;

a switching lever linked to the movable body and driven by the electrical drive unit to move the movable body; and a first engagement piece arranged on the locking lever and a second engagement piece arranged on the switching lever;

wherein when the locking lever is located at the unlock position, the second engagement piece engages with the first engagement piece when the movable body is located at the set position to limit movement of the switching lever so that movement of the movable body is restricted within a range between the unset position and the set position; and when the locking lever is located at the lock position, the first engagement piece is arranged at a position avoiding engagement with the second engagement piece to allow the switching lever to move the movable body between the unset position and the double lock position.

2. The door lock device according to claim 1, further comprising:

a middle lever connected to the vehicle door and slidably supporting the movable body;

wherein the movable body is pushed by the switching lever as the switching lever moves thereby moving the movable body between the unset position, the set position, and the double lock position while sliding in a longitudinal direction of the middle lever.

3. The door lock device according to claim 2, wherein the middle lever is linked to the inside lever by the movable body when the movable body is located at the set position so as to move integrally with the inside lever, and the middle lever includes a pushing piece, the door lock device further comprising:

a release lever linked to the locking lever, in which the release lever is pushed by the pushing piece as the inside lever moves when the locking lever is located at the lock position and the movable body is located at the set position, so that the release lever operates to move the locking lever to the unlock position.

4. The door lock device according to claim 3, wherein the release lever is pushed by the pushing piece as the inside lever moves when the movable body is located at the unset position and the locking lever is located at the lock position and thereby operates to move at least the locking lever to the unlock position.

5. The door lock device according to claim 2, wherein the inside lever, the inside open lever, and the middle lever are rotatably supported by the vehicle door about the same axis.

6. The door lock device according to claim 1, further comprising:

an urging member that selectively holds the switching lever to hold the movable body at the unset position, the set position, and the double lock position.

7. The door lock device according to claim 6, wherein the switching lever is selectively switched to pivotal positions corresponding to the unset position, set position, or double lock position of the movable body in accordance with the unlock position or lock position of the locking lever by a drive force of the electrical drive unit and an urging force of the urging member.

8. The door lock device according to claim 7, wherein the urging member is a restraining spring.

9. The door lock device according to claim 1, wherein the first engagement piece is arranged in a movement path of the second engagement piece when the locking lever is located at the unlock position, and the first engagement piece is arranged outside the movement path of the second engagement piece when the locking lever is located at the lock position.

10. The door lock device according to claim 1, wherein the movable body is movable, via the set position, between the unset position and the double lock position.

11. The door lock device according to claim 3, wherein the inside lever, the inside open lever, and the middle lever are rotatably supported by the vehicle door about the same axis.

12. The door lock device according to claim 11, further comprising:

an urging member that selectively holds the switching lever to hold the movable body at the unset position, the set position, and the double lock position.

13. The door lock device according to claim 12, wherein the switching lever is selectively switched to pivotal positions corresponding to the unset position, set position, or double lock position of the movable body in accordance with the unlock position or lock position of the locking lever by a drive force of the electrical drive unit and an urging force of the urging member.

14. The door lock device according to claim 12, wherein the urging member is a restraining spring.

15. The door lock device according to claim 4, wherein the inside lever, the inside open lever, and the middle lever are rotatably supported by the vehicle door about the same axis.

16. The door lock device according to claim 15, further comprising:

an urging member that selectively holds the switching lever to hold the movable body at the unset position, the set position, and the double lock position.

17. The door lock device according to claim 16, wherein the switching lever is selectively switched to pivotal positions corresponding to the unset position, set position, or double lock position of the movable body in accordance with the unlock position or lock position of the locking lever by a drive force of the electrical drive unit and an urging force of the urging member.

18. The door lock device according to claim 16, wherein the urging member is a restraining spring.

19. The door lock device according to claim 2, wherein the movable body is movable, via the set position, between the unset position and the double lock position.

20. The door lock device according to claim 3, wherein the movable body is movable, via the set position, between the unset position and the double lock position.

* * * * *